US010525529B2

(12) United States Patent
Stoyanov et al.

(10) Patent No.: US 10,525,529 B2
(45) Date of Patent: Jan. 7, 2020

(54) CORROSION-RESISTANT ALUMINUM-BASED ABRADABLE COATINGS

(71) Applicant: United Technologies Corporation, Farmington, CT (US)

(72) Inventors: Pantcho P. Stoyanov, West Hartford, CT (US); Christopher W. Strock, Kennebunk, ME (US); Thomas J. Watson, South Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 318 days.

(21) Appl. No.: 15/417,873

(22) Filed: Jan. 27, 2017

(65) Prior Publication Data

US 2018/0361471 A1 Dec. 20, 2018

(51) Int. Cl.

| | |
|---|---|
| ***B22F 1/00*** | (2006.01) |
| ***C23C 24/04*** | (2006.01) |
| ***F01D 5/28*** | (2006.01) |

(52) U.S. Cl.

CPC ..... *B22F 1/0059* (2013.01); *C23C 24/04* (2013.01); *F01D 5/288* (2013.01); *B22F 2301/052* (2013.01); *B22F 2301/15* (2013.01); *B22F 2301/205* (2013.01); *B22F 2303/01* (2013.01); *B22F 2303/05* (2013.01); *B22F 2999/00* (2013.01); *F05D 2230/90* (2013.01); *F05D 2300/611* (2013.01)

(58) Field of Classification Search

None

See application file for complete search history.

(56) References Cited

U.S. PATENT DOCUMENTS

| | | | | |
|---|---|---|---|---|
| 7,875,132 B2 * | 1/2011 | Pandey | ..... | C22F 1/04 148/415 |
| 2016/0031012 A1 * | 2/2016 | DeMichael | ..... | B22F 3/16 419/28 |
| 2016/0168663 A1 * | 6/2016 | Watson | ..... | C22C 21/00 419/67 |

FOREIGN PATENT DOCUMENTS

| | | |
|---|---|---|
| WO | 2015/006466 A1 | 1/2015 |
| WO | 2015/123274 A1 | 8/2015 |

OTHER PUBLICATIONS

European Search Report dated May 30, 2018 for European Patent Application No. 18153751.5.

Aluminum Silicon Polymer Thermal Spray Powders, Material Product Data Sheet, Apr. 2016, Oerlikon Metco, Winterthur, Switzerland.

Aluminum 12% Silicon Thermal Spray Powders, Material Product Data Sheet, Apr. 2016, Oerlikon Metco, Winterthur, Switzerland.

Thermal Spray Materials Guide, Apr. 2015, Oerlikon Metco, Winterthur, Switzerland.

Scott Wilson, Thermally Sprayed Abradable Coating Technology for Sealing in Gas Turbines, White Paper—Thermally Sprayed Abradable Coatings, Oct. 2012, Oerlikon Metco AG, Wohlen, Switzerland.

* cited by examiner

*Primary Examiner* — Daniel J. Schleis

(74) *Attorney, Agent, or Firm* — Bachman & LaPointe, P.C.

(57) ABSTRACT

A coated article comprising: a substrate; and a coating on the substrate comprising: a metallic matrix comprising, by weight: Al as a largest constituent; 3.0-6.0 Cr; 1.5-4.0 Mn; 0.1-3.5 Co; and 0.3-2.0 Zr; and a filler and optionally porosity.

25 Claims, 3 Drawing Sheets

CORROSION-RESISTANT ALUMINUM-BASED ABRADABLE COATINGS

BACKGROUND

The disclosure relates to abradable coatings. More particularly, the disclosure relates to cold section abradable coatings for gas turbine engines.

Abradable rub materials are used in all stages of gas turbine engines (broadly inclusive of aero engines, industrial gas turbines, and the like). They may line the inner diameter (ID) surfaces of case segments, blade outer air seals (BOAS), or similar components facing airfoil tips.

A wide variety of rub materials are used, varying largely with the position in the engine. Position is highly correlated with temperature, with temperature generally increasing downstream through the fan (if any) and compressor stages and spiking in the combustor and then decreasing through the turbine stages. The "cold section" of the engine is generally identified as being upstream of the combustor. In lower temperature (upstream) regions of the cold section, one family of aluminum-based coatings has an Al—Si matrix. METCO 601NS (trademark of Oerlikon Metco, Winterthur, Switzerland) is a known example having 7 weight percent Si, 40 weight percent polyester, remainder Al. These may be a blended powder applied by atmospheric plasma spray. The polyester (or other polymer) acts as a fugitive which burns or volatizes off in a post-application heat treatment or in engine operation. Variants have been proposed including additional non-metallic fillers such as solid lubricants (e.g., hexagonal boron nitride (hBN)).

In cold section applications, such material typically interfaces with titanium alloy blades (e.g., Ti6Al4V).

Separately, United States Patent Application Publication 20160168663 A1, of Thomas J. Watson et al., Jun. 16, 2016 and entitled "Aluminum Alloys and Manufacture Methods", hereinafter the '663 publication, the disclosure of which is incorporated by reference herein in its entirety as if set forth at length, discloses I-phase aluminum alloys used, e.g., in blades.

SUMMARY

One aspect of the disclosure involves a coated article comprising: a substrate; and a coating on the substrate comprising: a metallic matrix comprising, by weight: Al as a largest constituent; 3.0-6.0 Cr; 1.5-4.0 Mn; 0.1-3.5 Co; and 0.3-2.0 Zr; and a filler and optionally porosity.

A further embodiment may additionally and/or alternatively include in the matrix, in atomic percent content, Co divided by the sum (Cr+Mn) being less than or equal to 0.07.

A further embodiment may additionally and/or alternatively include in the matrix, in atomic percent content, Co divided by the sum (Cr+Mn) being less than or equal to 0.065.

A further embodiment may additionally and/or alternatively include the matrix comprising, in weight percent: 3.0-6.0 Cr; 1.5-4.0 Mn; 0.1-1.0 Co; and 0.3-1.5 Zr.

A further embodiment may additionally and/or alternatively include the matrix comprising, in weight percent: 3.7-5.2 Cr; 2.1-3.0 Mn; 0.4-0.6 Co; and 0.7-1.1 Zr.

A further embodiment may additionally and/or alternatively include the matrix comprising, in atomic percent: 1.9-2.9 Cr; 1.0-1.6 Mn; 0.2-0.3 Co; and 0.2-0.4 Zr.

A further embodiment may additionally and/or alternatively include in the matrix, in weight percent, the total of all additional contents being not more than 5.0.

A further embodiment may additionally and/or alternatively include in the matrix, in weight percent, no additional individual elemental content exceeding 1.0.

A further embodiment may additionally and/or alternatively include in the matrix, in weight percent, each of Fe and Si content, if any, not exceeding 0.02.

A further embodiment may additionally and/or alternatively include in the matrix, by weight, H content, if any, does not exceed 1 ppm.

A further embodiment may additionally and/or alternatively include the matrix having an icosahedral phase (I-phase).

A further embodiment may additionally and/or alternatively include a volume fraction of said I-phase in the matrix being 15% to 30%.

A further embodiment may additionally and/or alternatively include a characteristic size of said I-phase being less than 200 nm.

A further embodiment may additionally and/or alternatively include in the matrix, an $Al_9Co_2$ content, if any, being less than 5% by volume.

A further embodiment may additionally and/or alternatively include a combined content, by volume of the coating being: 20-40% said matrix; and 60-80% said filler and optional porosity.

A further embodiment may additionally and/or alternatively include said filler comprising hBN or $MoS_X$ forming at least 5 weight percent of the coating.

A further embodiment may additionally and/or alternatively include the coated article being a blade outer air seal.

A further embodiment may additionally and/or alternatively include a gas turbine engine including the blade outer airseal and further comprising a stage of blades adjacent the blade outer airseal.

A further embodiment may additionally and/or alternatively include a method for manufacturing the coated article, the method comprising spraying a powder of material of the matrix and a powder of material of the filler.

A further embodiment may additionally and/or alternatively include the spraying being a co-spraying.

A further embodiment may additionally and/or alternatively include the spraying further comprising spraying of a powder porosity-former.

A further embodiment may additionally and/or alternatively include the spraying being cold spraying.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
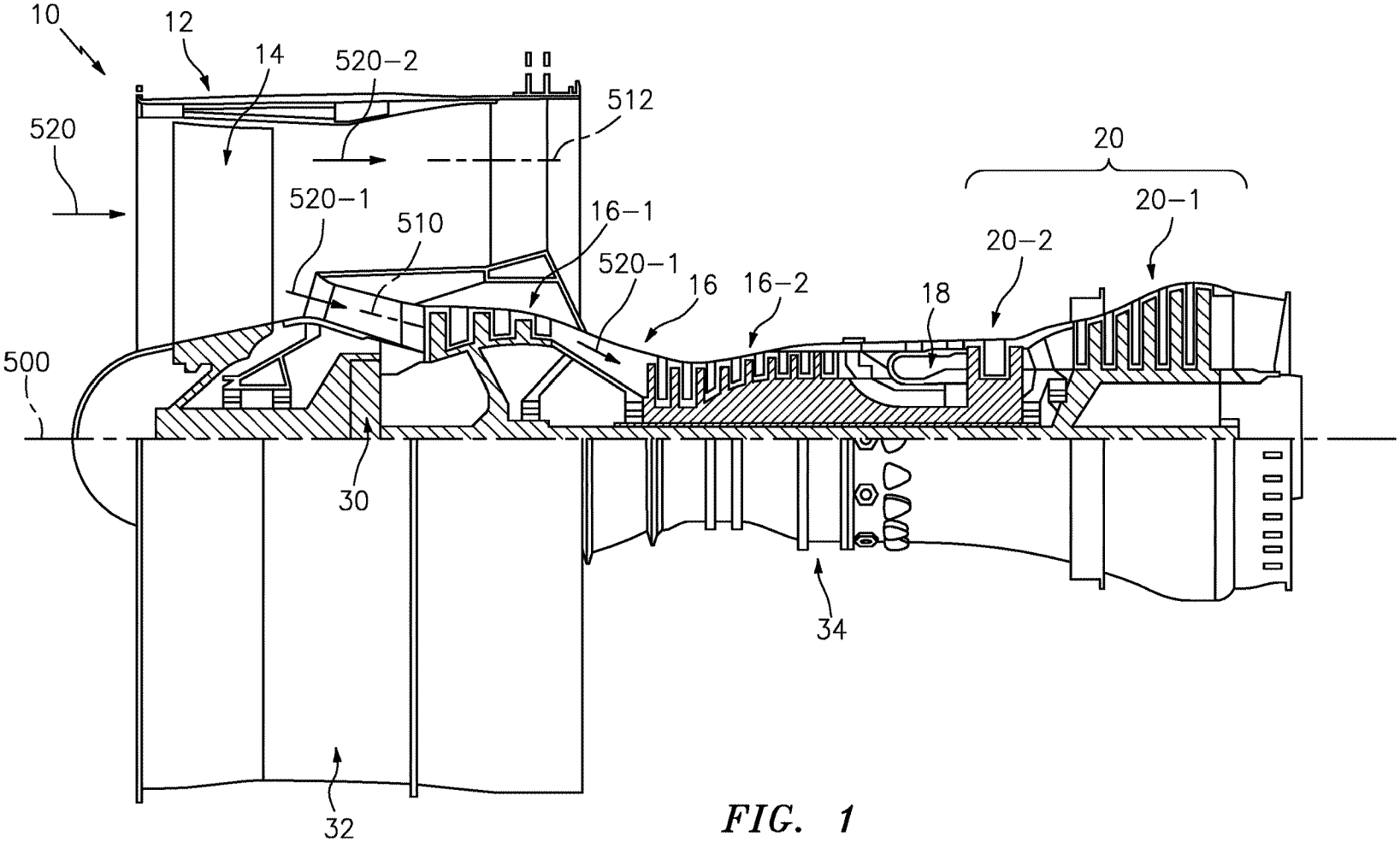
FIG. 1 is a schematic axial half cross-sectional view of an embodiment of a gas turbine engine.

In tests of Al—Si abradable coatings in simulated service conditions we have observed coating distress and spallation.

This is believed caused by corrosion of the aluminum alloy. One situation involves corrosion at the interface with a bondcoat and may lead to spallation. Another situation involves failure within the coating. Within the coating, oxidation leads to hardening by filling porosity with corrosion products oxide and hydroxide, swelling with the volume expansion of these products. Corrosion has led to blade wear, opening of tip clearance by flaking or chunking out and has caused damage to the adjacent blade tips as domestic object damage (DOD).

By using I-phase alloys such as in the '663 publication but as a powder feedstock for matrix of an abradable coating, the Al—Si failure mechanisms may be mitigated. The self-passivation properties are believed to reduce mechanical failures within the matrix by limiting the volume of oxide and corrosion products generated. Bonding failures and spallation at the bond interface that result from galvanic interaction between the bondcoat and the aluminum matrix abradable layer. The passivation layer is believed to interrupt the galvanic interaction between matrix and bondcoat (particularly in implementations where the abradable layer is directly atop the bondcoat).

Table I below lists compositions taken from the '663 publication:

TABLE I

Matrix Composition

| Example | W/A % | Element Cr | Mn | Co | Zr | Co/(Cr + Mn) | I-Phase %* |
|---|---|---|---|---|---|---|---|
| Range 1 | W | 3.7-5.2 | 2.1-3.0 | 0.4-0.6 | 0.7-1.1 | | |
| | A | 1.9-2.9 | 1.0-1.6 | 0.18-0.3 | 0.2-0.4 | | |
| Range 2 | W | 3.5-5.5 | 1.9-3.2 | 0.3-0.8 | 0.5-1.2 | | |
| Range 3 | W | 3.0-6.0 | 1.5-4.0 | 0.1-1.0 | 0.3-1.5 | | |
| Range 4 | W | 3.0-6.0 | 1.5-4.0 | 0.1-3.5 | 0.3-2.0 | | |
| Test 1 | W | 4.96 | 2.84 | 3.14 | 1.5 | | 28 |
| | A | 2.76 | 1.49 | 1.54 | 0.48 | 0.362 | |
| Example 1 | W | 3.7 | 2.1 | 0.42 | 0.99 | — | 20 |
| | A | 1.995 | 1.082 | 0.2 | 0.304 | 0.063 | |
| Example 2 | W | 4.59 | 2.63 | 0.51 | 0.99 | — | 25 |
| | A | 2.495 | 1.353 | 0.245 | 0.307 | 0.064 | |
| Example 3 | W | 5.12 | 2.93 | 0.57 | 0.98 | — | 28 |
| | A | 2.795 | 1.514 | 0.275 | 0.305 | 0.064 | |

In each range, aluminum would form the majority by weight percent of the composition and, more particularly, substantially the remainder/balance (e.g., enough of the remainder to avoid significant compromise in properties). For example, to the extent any constituents beyond the enumerated Al, Cr, Mn, Co, and Zr are present, they would be expected to aggregate no more than 5 weight percent (more narrowly, no more than 2 weight percent and yet more narrowly, no more than 1 weight percent). Each additional element, individually, would be expected to be no more than 2 weight percent, more narrowly, no more than 1.0 weight percent, more particularly, no more than 0.5 weight percent.

However, as noted above, there are several specific elements for which much lower upper limits may be present. These include H, Fe, and Si. Exemplary maximum H is 10 ppm, more narrowly, 5 ppm, more narrowly, 2 ppm, more narrowly, 1 ppm. Exemplary Fe and Si maximum contents are each no more than 0.1 weight percent, more particularly, no more than 0.05 weight percent or 0.03 weight percent or 0.02 weight percent.

As noted above, for any of these ranges the atomic ratio of Co to the sum of Cr and Mn may be less than or at most 0.065, more broadly, less than or at most 0.07 or 0.10, and more narrowly, 0.050-0.065.

Exemplary $Al_9Co_2$ content, if any, is less than or at most 5.0% by volume, more particularly, less than or at most 2.0% or less than or at most 1.0%.

Furthermore, exemplary I-phase volume percentage is up to or less than 30%, more particularly, 15% to 30% or 18% to 28%. Exemplary characteristic (e.g., average) I-phase size is up to or less than 1000 nm, more particularly, up to or less than 500 nm or up to or less than 200 nm.

The matrix material may be co-sprayed with fugitive porosity former (e.g., polymer/plastic such as polyester, polyimide, methylmethacrylate, and the like or a soluble salt or other particulate that could be removed by leaching or burning or the like) and/or a more persistent filler (e.g., including solid lubricants or other soft filler). Exemplary such non-metallic fillers include hBN, $MoS_X$ (e.g., $MoS_2$ and/or $MoS_3$), and bentonite. Exemplary soft filler may be selected for any of several properties and benefits. Versus added matrix volume fraction, it may increase abradability. Versus increased porosity, the soft filler may increase integrity to increase life and may act as a barrier to air and chemical infiltration through the pores, where air infiltration contributes to a loss in aerodynamic efficiency. The soft filler may also limit adhesion of metal particles and interfere with the smearing and material transfer often associated with rub interactions.

A very broad range of relative contents of solid lubricant and porosity are possible in the abradable layer. Within the abradable layer, an exemplary by volume content of the metal is 20% to 50%, more particularly 25% to 40%, or an exemplary about 35%. An exemplary porosity is up to or less than 70% by volume, more particularly 1.0% to 7%, or 10.0% to 70%, or 25.0% to 70%; or 40% to 70% or 45% to 65% or an exemplary about 55% in embodiments that have significant porosity. Other embodiments may target low porosity (e.g., 0% to 15% or 1% to 10% or 2% to 8% or an exemplary about 5%) with high solid lubricant content. Exemplary solid lubricant volumetric contents if present are at least 2% or at least 10% or an exemplary 10% to 30% in higher porosity layers and 50% to 80% or 60% to 80% or 65% to 75% in the low porosity embodiments. Any of the respective ranges of metal, porosity, and filler may coexist with totaling to 100% acting as a further restriction.

The numbers in the paragraph above are as-applied. Feedstock may differ due to differing deposition efficiencies (e.g., the porosity former may experience attrition so that the deposited volume and mass fractions of the porosity former are less than those in the feedstock). Additionally, there may be porosity beyond spaces vacated by porosity former (once burned, volatilized, leached, dissolved, or the like out of the coating). However the difference is expected to be small and the same numbers may be used both for as-applied porosity former and subsequent overall porosity.

In terms of weight percent, in a coating where the porosity former has been vaporized or otherwise removed to leave porosity, exemplary non-metallic filler content may be at least 2% or at least 5% or an exemplary 5% to 10%.

Exemplary application is by spray. Exemplary spray is air plasma spray. Alternatives include flame spray, high velocity oxygen fuel spray, high velocity air fuel spray and other thermal spray processes. Exemplary spray is from a blend of powders of the matrix material, filler (if any), and porosity former (if any). Alternative feedstocks include separating out one or more of the components in to separate sources for a given spray torch or separate spray torches. Other alternative feedstocks include variations such as cladding powder particles of the filler (if any) or the porosity former (if any) with Matrix material.

Spray may be directly on a substrate or on a substrate to which a layer such as a bondcoat has already been applied. A variety of substrate materials may be used, depending on location in the engine. These include Al alloys, Ti alloys, Fe alloys Ni alloys, metallic and non-metallic composites. Fe and Ni alloys are particularly relevant with Ti-alloy blades due to better ability to withstand Ti fires. Other blade materials include Al alloys, non-metallic composites and hybrids/combinations.

Exemplary abradable coating thickness or depth is 0.080 mm to 7.62 mm, more particularly 0.20 mm to 2.54 mm. Different applications may have different target ranges, for example, helicopter engines have relatively lower incursion rates than do thrust-producing aircraft engines such as turbofans. Helicopter engines are typically smaller than thrust-producing airplane engines or at least at the low end of the size range. The effects of bowed starts may also be more significant with larger engines. Coupling to the rotor means that helicopter engines may be subject to slower acceleration rates and lower redline frequencies than corresponding thrust engines. Such factors tend to justify a thinner coating for helicopter engines.

Exemplary abradable coating thickness or depth for thrust-producing engines is 0.76 mm to 7.62 mm, more particularly 1.50 mm to 2.54 mm. Exemplary abradable coating thickness or depth for helicopter engines is 0.080 mm to 0.76 mm, more particularly 0.080 mm to 0.50 mm. Nevertheless small thrust producing engines (e.g. for small unmanned aerial vehicles) may have thicknesses as outlined for helicopter engines.

In various examples, the coating has essentially depthwise constant structure (e.g., fraction of matrix, filler and porosity former or porosity. Thus, there may be slight compositional variation due, for example to changing relative deposition efficiencies during the buildup (e.g., including any starting or stopping transients). In other variations, there may be a substantial depthwise compositional gradation (e.g., intended to balance required strength, abradablility, lubricity or the like).

Thus, compositions discussed may be local, depthwise local average, depthwise average across an area of the substrate, or the like.

Exemplary bondcoat is based on a NiAl such as Ni5Al. The ultimate bondcoat may reflect diffusion relative to the particular precursor (e.g., Ni5Al). Alternatives include MCrAlY (e.g., a NiCoCrAlY such as Ni 23Co 17Cr 12Al 0.5Y) or NiCrAl alloys. Exemplary application techniques include plasma spray. Exemplary bondcoat thickness or depth is 0.070 mm to 0.30 mm, more particularly 0.10 mm to 0.18 mm.

Exemplary fan case substrate materials are Ti alloys or Al alloys. Other substrate materials include Ni alloys and steels, particularly for more downstream compressor sections.

Particularly relevant are military-style low bypass turbofan engines. Whereas high bypass commercial engines typically have a single stage fan interfacing with a non-metallic rub coating on the inner diameter surface of the fan case, military-style low bypass turbofans often have multiple stages of metallic fan blades often similar to compressor blades. On an exemplary two-spool engine, relevant locations will include the fan stages (for a military engine), the low pressure compressor (LPC) stages, and the upstream-most stages of the high pressure compressor (HPC). Downstream HPC stages are more likely to be too hot for an Al-based matrix.

In a military engine where the fan case is often a split Ti alloy case (e.g., a 180° split between two case halves) coating integrity is particularly relevant for protecting the fan case. Higher bypass civilian-style turbofans use different fan case structural and rub materials.

FIG. 1 is a schematic illustration of a gas turbine engine 10. The illustrated engine is a turbofan used to produce propulsive thrust in aerospace applications, namely a high bypass civilian-style turbofan. Broadly, relevant gas turbine engines may also include turbojets, turboprops, industrial gas turbines (IGT), and the like. For purposes of illustration, outer aerodynamic cases are not shown. The gas turbine engine has a central longitudinal axis 500. The gas turbine engine generally has a fan section 12 through which an inlet flow 520 of ambient air is propelled by a fan 14, a compressor 16 for pressurizing the air 520-1 received from the fan 14, and a combustor 18 wherein the compressed air is mixed with fuel and ignited for generating combustion gases. The inlet flow 520 splits into a first or core portion 520-1 flowing along the gaspath (core flowpath) 510 and a bypass portion 520-2 flowing along a bypass flowpath 512. The illustrated engine 10 and gross features of its airseals (discussed below) are based on a particular configuration. Nevertheless, the teachings herein may be applied to other general engine configurations and other general airseal configurations.

The gas turbine engine 10 further comprises a turbine 20 for extracting energy from the combustion gases. Fuel is injected into the combustor 18 of the gas turbine engine 10 for mixing with the compressed air from the compressor 16 and ignition of the resultant mixture. The fan 14, compressor 16, combustor 18, and turbine 20 are typically all concentric about a common central longitudinal axis 500 of the gas turbine engine 10.

Depending upon the implementation, the compressor and turbine may each contain multiple sections. Each section includes one or more stages of rotor blades interspersed with one or more stages of stator vanes. The exemplary configuration has two compressor sections and two turbine sections. From upstream to downstream along the gaspath 510, these include a low pressure compressor section (LPC) 16-1, a high pressure compressor section (HPC) 16-2, a high pressure turbine section (HPT) 20-2, and a low pressure turbine section (LPT) 20-1. The exemplary rotors of the LPC and LPT are formed to rotate as a first unit or low pressure spool with the LPT driving the LPC. Similarly, the HPT and HPC rotors are arranged as a high pressure spool. The fan may be driven by the low pressure spool either directly or via a reduction gearbox 30. Other configurations are, however, known. Whereas illustrated in the context of compressors 16, one skilled in the art will readily appreciate that the present disclosure may be utilized with respect to turbines (e.g., an LPT where temperatures are relatively low).

Figure 2:
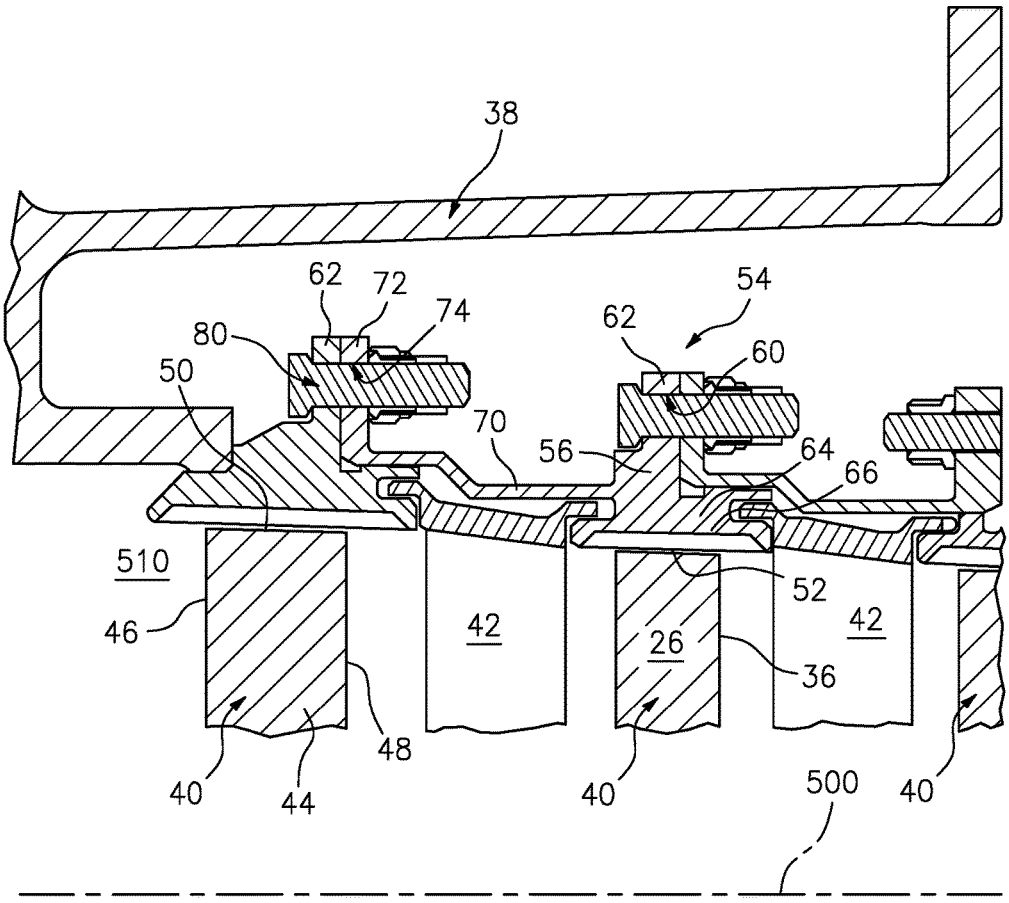
FIG. 2 is a schematic axial cross-sectional view of an embodiment of a compressor of the gas turbine engine.

The exemplary engine comprises a fan case 32 and a core case 34. The core case has sections along the corresponding sections of the engine core. FIG. 2 shows an HPC case section 38 of the core case 34 along the HPC.

FIG. 2 schematically shows several stages of blades 40 of the HPC rotor. Interspersed with the blades are stages of stator vanes 42. Each blade has an airfoil 44 having a leading edge 46, a trailing edge 48, a pressure side (not shown) and a suction side (not shown) and extends from an inboard end to an outboard tip 50. The tip 50 is in close facing proximity to an inner diameter (ID) surface 52 of an outer airseal 54. Each exemplary outer airseal 54 includes a metallic substrate 56 and an abradable coating system (or rub strip) 58 (FIG. 2A) forming the ID surface 52 along an ID surface of the substrate.

The exemplary outer airseal 54 is formed as a generally full annulus (e.g., locally interrupted by mounting features such as a circumferential array of holes 60 in a radially outwardly extending flange 62). In cross-section, the exemplary outer airseals 54 comprise an inboard body or band 64 comprising a body or band 66 of the substrate and the rub strip 58 inboard thereof. The flange 62 extends radially outward from the band 66. For mounting the exemplary airseals, at a forward end of the flange 62, an axial collar portion 70 extends forwardly to terminate in a radially outward extending flange 72. The flange 72 has mounting holes 74 complementary to mounting holes of an adjacent mating flange. FIG. 2 shows several airseal stages associated with respective blade stages. Each flange 72 may mate to a flange 62 of the next forward airseal and be secured thereto via fasteners (e.g., threaded fasteners) 80.

Figure 2A:
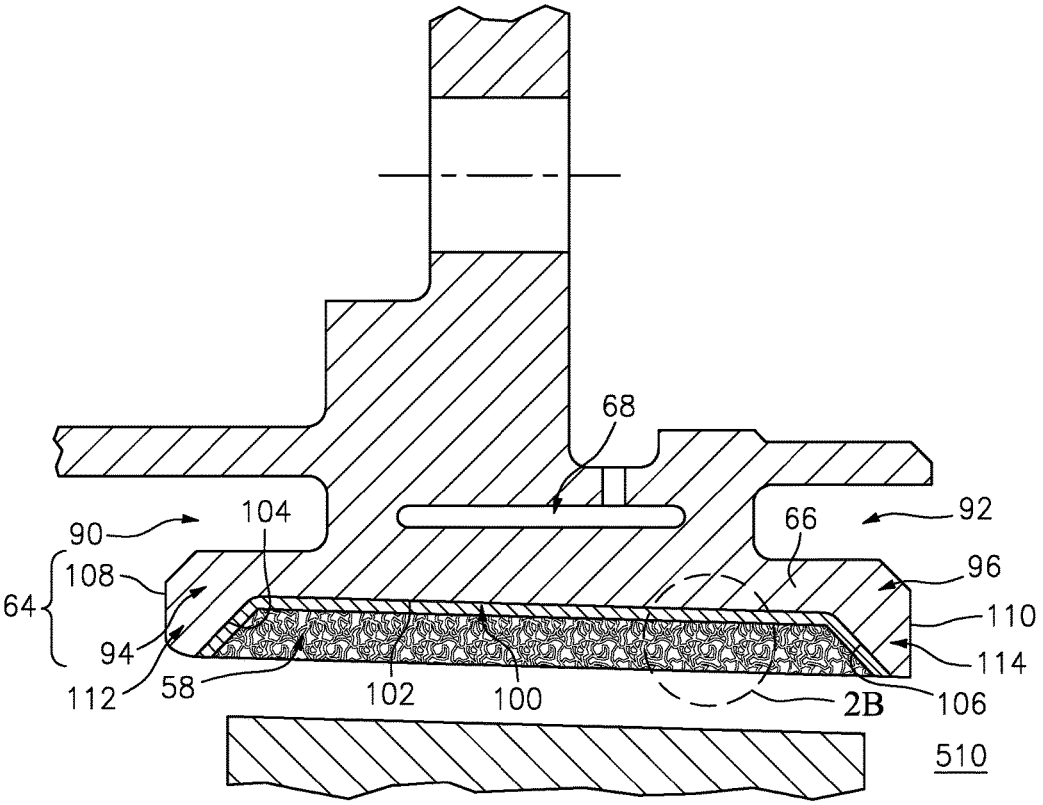
FIG. 2A is a schematic axial cross-sectional view of an embodiment of an outer airseal of the compressor of the a gas turbine engine at detail 2A of FIG. 2.

FIG. 2A further shows respective fore and aft channels 90 and 92 outboard of corresponding cantilevered portions 94 and 96 of the substrate band 66 for capturing associated flanges of adjacent stages of stator segments.

The exemplary rub strip 58 (FIG. 2A) is located in an inwardly (radially) open annular channel 100 or well in the substrate band portion 66. The channel has a surface comprising a base surface 102 and respective fore and aft surfaces 104 and 106.

The band 66 extends from a forward rim 108 to an aft rim 110 and has forwardmost and aftmost portions 112 and 114 respectively forward of and behind the channel 100.

Figure 2B:
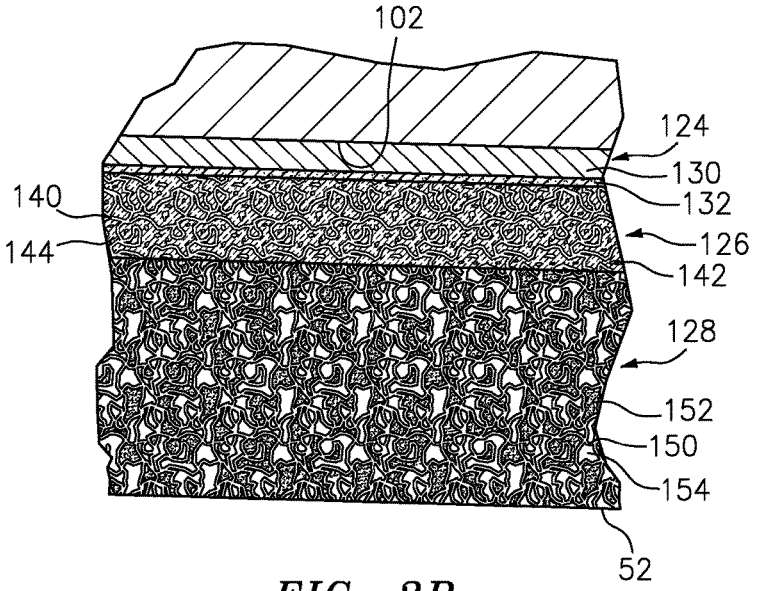
FIG. 2B is a coating cross section at detail 2B of FIG. 2A.

The rub strip 58 may be formed with multiple layers. A base layer 124 (FIG. 2B) may be a bondcoat atop an inner diameter (ID) surface portion of the substrate band formed by the channel surfaces (102, 104, 106). An optional thermal barrier coating (TBC) layer 126 is at least locally atop the bondcoat. An abradable layer 128 is at least locally atop the TBC layer (or atop the bondcoat if no TBC layer or otherwise positioned). The abradable layer 128 may represent modification of any appropriate prior art or future abradable layer composition but featuring matrix alloy discussed below. The TBC layer 126, if present, may be selected for insulative purposes to limit or tailor the flow of heat from the gaspath 510 to the substrate 56. In situations of Ti airfoils, the TBC layer may serve fire containment purposes.

The exemplary bondcoat 124 includes a base layer 130 and a thermally grown oxide (TGO) layer 132. The base layer and TGO layer may originally be deposited as a single precursor layer. There may be diffusion with the substrate. The TGO layer may reflect oxidation of original material of the precursor. Exemplary base layer thicknesses are 10-400 micrometers, more narrowly 20-200 micrometers. Exemplary TGO layer thicknesses are 0.05-1 micrometers, more narrowly 0.1-0.5 micrometers. Alternative bondcoats include diffusion aluminides.

An exemplary coating process includes preparing the substrate (e.g., by cleaning and surface treating). Depending upon the nature of the bondcoat, the bondcoat may be applied in essentially final form or a precursor of the bondcoat (the bondcoat reflecting diffusion relative to the precursor) is applied. An exemplary application is via a spray (e.g., a thermal spray) from a powder source. Exemplary application is via air plasma spray (APS). Alternative methods include a high-velocity oxy-fuel (HVOF) process, a high-velocity air-fuel (HVAF) process, a low pressure plasma spray (LPPS) process, or a wire-arc process.

After the application, the precursor may be diffused An exemplary diffusion is via heating (e.g., to at least 1900° F. (1038° C.) for a duration of at least 4 hours) in vacuum or nonreactive (e.g., argon) atmosphere. The exemplary diffusion may create a metallurgical bond between the bondcoat and the substrate. Alternatively diffusion steps may occur after applying the TBC, if at all.

After application of the bondcoat precursor, if any, the substrate may be transferred to a coating apparatus for applying the TBC 126, if any, and abradable layer 128. An exemplary application is via a spray (e.g., a cold spray as discussed above or a thermal spray) from a powder source. Exemplary application is via cold spray. Alternative methods include an air plasma spray (APS) process, a high-velocity oxy-fuel (HVOF) process, a high-velocity air-fuel (HVOF) process, a low pressure plasma spray (LPPS) process, or a wire-arc process.

Alternative non-spray techniques involve consolidated and sintered powder including pressing, tape casting, and vibratory consolidation. These may include direct write, DMLS and laser fusing 3D printing with or without binders. As an alternative to in situ formation directly on the substrate (optionally with a bond coat or other layer(s)) preformed layers may be brazed or adhesively bonded or otherwise to the substrate (or to an intervening layer).

An exemplary TBC 126, if present, comprises a single ceramic-containing layer of a single nominal composition. Multi-layer and graded composition embodiments are also possible. An exemplary abradable layer 128 is a metal matrix composite. An exemplary metal matrix composite comprises the metal (alloy) matrix mentioned above, a non-metallic filler such as solid lubricant as mentioned above, and porosity.

The exemplary TBC 126 contains metal (alloy) 140 and porosity 142 in addition to the ceramic 144. The exemplary by volume content of metal in the TBC is less than in the abradable layer.

Within the TBC 126, an exemplary ratio of ceramic 144 to metal 140 by volume is between 3:1 and 50:1, more particularly between 5:1 and 20:1 or between 5:1 and 10:1 or an exemplary about 7:1. An exemplary remainder (e.g., porosity plus solid lubricant in some embodiments as discussed below) is up to 70% by volume, more particularly 2% to 70%, or 5% to 60% or 20% to 50% or 30% to 45% or an exemplary about 40%.

The ceramic 144 (e.g., a stabilized zirconia such as a yttria-stabilized zirconia (YSZ), particularly 7YSZ) contributes to the composite low conductivity and strength. The metal 140 greatly increases toughness and spallation resistance. Porosity (if any) created inherently by the application (e.g., spray) process and/or via addition of a fugitive filler material further reduces conductivity, but also contributes to reduced elastic modulus, coating stress and tendency to spall (i.e., both the metallic content and porosity increase the possible thickness of the TBC 126 and therefore maximum thermal resistance of the system). At some point with increasing porosity the TBC gets weak and allows abradable spallation. To mitigate this, the TBC may be selected to be stronger than the abradable.

The exemplary abradable layer 128 contains the I-phase (alloy) 150 described above and a filler such as solid lubricant 152 as noted above. It may further contain porosity 154 noted above.

In various implementations, the metal 140 of the TBC may also be an I-phase alloy and may have the same, similar, or different composition to the metal 150.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Other engine situations include knife edge seal applications where the abradable coating is on the seals that knife edges (optionally abrasive-coated or wear coated) rub into. Such seals are often associated with shrouded vanes and bearing compartments. Accordingly, other embodiments are within the scope of the following claims.

What is claimed is:

1. A coated article comprising:

a substrate; and a coating on the substrate comprising:

a metallic matrix having an icosahedral phase (I-phase) and comprising, by weight percent:

Al as a largest constituent;

3.0-6.0 Cr;

1.5-4.0 Mn;

0.1-3.5 Co; and 0.3-2.0 Zr; and a filler and optionally porosity.

2. The coated article of claim 1 wherein:

in the matrix, in atomic percent content, Co divided by the sum (Cr+Mn) is less than or equal to 0.07.

3. The coated article of claim 1 wherein:

in the matrix, in atomic percent content, Co divided by the sum (Cr+Mn) is less than or equal to 0.065.

4. The coated article of claim 1 wherein:

the matrix comprises, in weight percent:

3.0-6.0 Cr;

1.5-4.0 Mn;

0.1-1.0 Co; and 0.3-1.5 Zr.

5. The coated article of claim 1 wherein:

the matrix comprises, in weight percent:

3.7-5.2 Cr;

2.1-3.0 Mn;

0.4-0.6 Co; and 0.7-1.1 Zr.

6. The coated article of claim 1 wherein:

the matrix comprises, in atomic percent:

1.9-2.9 Cr;

1.0-1.6 Mn;

0.2-0.3 Co; and 0.2-0.4 Zr.

7. The coated article of claim 1 wherein:

in the matrix, in weight percent, the total of all additional contents is not more than 5.0.

8. The coated article of claim 1 wherein:

in the matrix, in weight percent, no additional individual elemental content exceeds 1.0.

9. The coated article of claim 1 wherein:

in the matrix, in weight percent, each of Fe and Si content, if any, does not exceed 0.02.

10. The coated article of claim 1 wherein:

in the matrix, by weight, H content, if any, does not exceed 1 ppm.

11. The coated article of claim 1 wherein:

a volume fraction of said I-phase in the matrix is 15% to 30%.

12. The coated article of claim 1 wherein:

a characteristic size of said I-phase is less than 200 nm.

13. The coated article of claim 1 wherein:

in the matrix, an $Al_9Co_2$ content, if any, is less than 5% by volume.

14. The coated article of claim 1 wherein a combined content, by volume of the coating is:

20-40% said matrix; and 60-80% said filler and optional porosity.

15. The coated article of claim 14 wherein:

said filler comprises hBN or $MoS_X$ forming at least 5 weight percent of the coating.

16. The coated article of claim 1 being a blade outer air seal.

17. A gas turbine engine including the blade outer airseal of claim 16 and further comprising:

a stage of blades adjacent the blade outer airseal.

18. A method for manufacturing the coated article of claim 1, the method comprising:

spraying a powder of material of the matrix and a powder of material of the filler.

19. The method of claim 18 wherein the spraying is a co-spraying.

20. The method of claim 18 wherein the spraying further comprises spraying of a powder porosity-former.

21. The method of claim 18 wherein the spraying is cold spraying.

22. A coated article comprising:

a substrate; and a coating on the substrate comprising:

a metallic matrix comprising, by weight percent:

Al as a largest constituent;

3.0-6.0 Cr;

1.5-4.0 Mn;

0.1-3.5 Co; and 0.3-2.0 Zr, wherein, in the matrix, in weight percent, no additional individual elemental content exceeds 1.0; and a filler and optionally porosity.

23. A coated article comprising:

a substrate; and a coating on the substrate comprising:

a metallic matrix comprising, by weight percent:

Al as a largest constituent;

3.0-6.0 Cr;

1.5-4.0 Mn;

0.1-3.5 Co; and 0.3-2.0 Zr; and a filler and optionally porosity wherein a combined content, by volume of the coating is:

20-40% said matrix; and 60-80% said filler and optional porosity.

24. The coated article of claim 23:

said filler comprises hBN or $MoS_X$ forming at least 5 weight percent of the coating.

25. A blade outer airseal comprising:

a substrate; and a coating on the substrate comprising:

a metallic matrix comprising, by weight percent:

Al as a largest constituent;

3.0-6.0 Cr;

1.5-4.0 Mn;

0.1-3.5 Co; and 0.3-2.0 Zr.

* * * * *